United States Patent [19]

Serata

[11] 4,084,384

[45] Apr. 18, 1978

[54] ADVANCED SLOT STRESS CONTROL METHOD OF UNDERGROUND EXCAVATION

[76] Inventor: Shosei Serata, 1229 8th St., Berkeley, Calif. 94710

[21] Appl. No.: 722,792

[22] Filed: Sep. 13, 1976

[51] Int. Cl.[2] ..... E01G 3/00

[52] U.S. Cl. ..... 61/42; 61/45 R; 61/84; 299/11; 299/19

[58] Field of Search ..... 61/45 R, 45 B, 45 C, 61/42, 36 R, 35; 299/10, 11, 18, 19, 44, 76

[56] References Cited

U.S. PATENT DOCUMENTS

| | | | |
|---|---|---|---|
| 1,268,584 | 6/1918 | Kuhn | 299/76 X |
| 1,290,020 | 12/1918 | Levin | 299/44 |
| 1,917,318 | 7/1933 | Nelms | 299/76 |
| 2,442,113 | 5/1948 | Beijl | 61/42 |
| 3,097,830 | 7/1963 | Love et al. | 299/19 X |
| 3,547,493 | 12/1970 | Starkle | 61/45 R X |
| 3,927,861 | 12/1975 | Dumont | 61/53 X |
| 3,968,655 | 7/1976 | McGlothlin | 61/45 R X |

*Primary Examiner*—Dennis L. Taylor
*Attorney, Agent, or Firm*—Harris Zimmerman

[57] ABSTRACT

An underground excavation method which reduces or eliminates the need for roof supports includes the cutting of one or more slots in a radial direction ahead of the advancing underground excavation. The plane of the slot is disposed perpendicular to the tangential stress that is expected around the prospective opening, so that the tangential stress is removed prior to the excavation of the opening, eliminating the potential damage to the boundary. The stress envelope finally formed after the excavation is radially expanded by the advanced slots, and can be made to stress-relieve the ground surrounding the excavation by controlling the length, number, and orientation of the advanced slots. The stress-relieved ground may be utilized as lining material by solidification with cement grouting or very limited anchor bolting.

5 Claims, 8 Drawing Figures

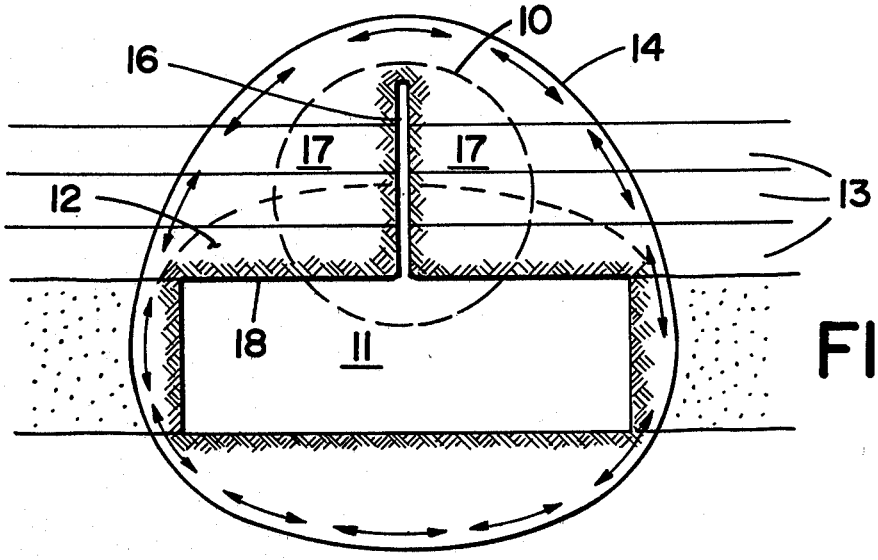
FIG _ 1
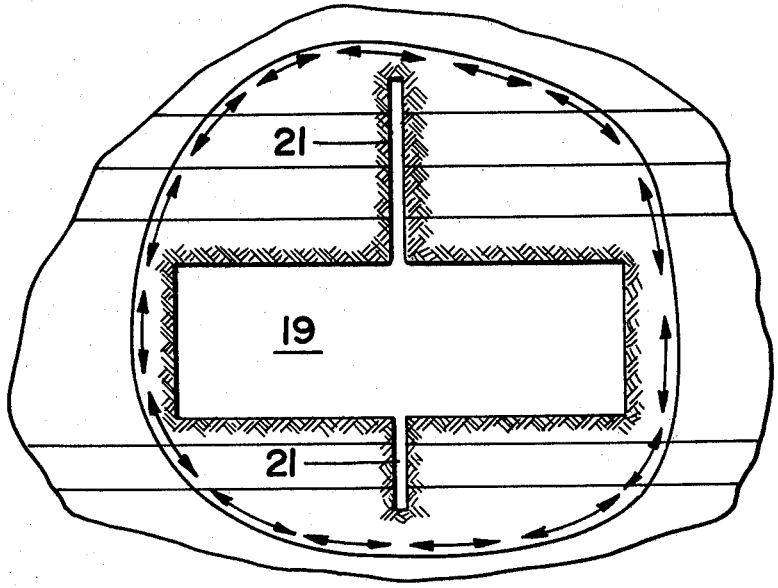
FIG _ 2
FIG _ 3
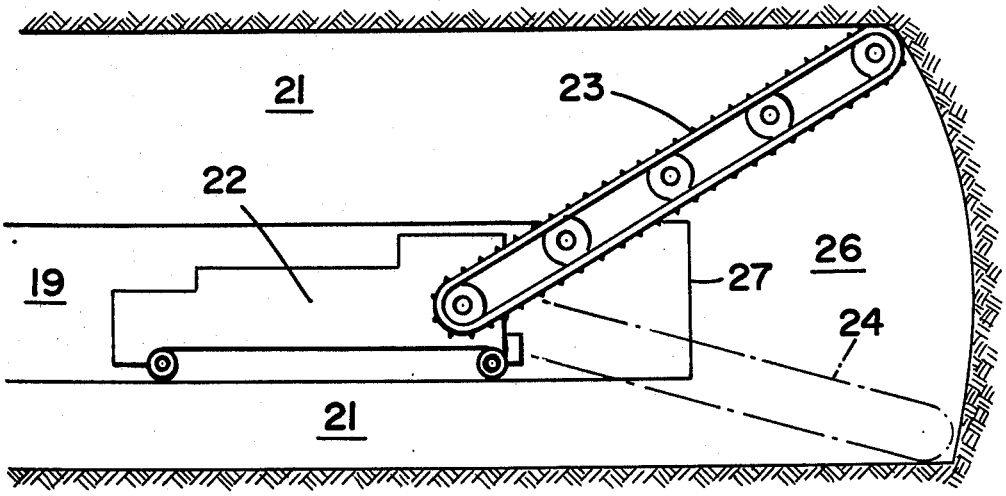

ADVANCED SLOT STRESS CONTROL METHOD OF UNDERGROUND EXCAVATION

BACKGROUND OF THE INVENTION

Most subsurface openings which are made in weak underground formations are subject to eventual failure if they are not provided with some artificial means of support. Vertical and horizontal stresses in the subsurface material tend to concentrate around openings, buckling and sloughing the boundary media around the openings and causing the opening to fail.

It is common practice to prevent such failure of the mine by mechanical means; i.e., anchor bolting to maintain the integrity of the opening boundary and/or lining of the boundary with concrete and steel to counteract the closure of the opening. These methods often involve considerable expense in labor and material, and are a significant cost factor in many situations.

In underground mining, the room-and-pillar method is widely used to provide support for the overlying strata while the intermediate material is excavated. This method also has inherent limitations and cost factors, due in part to the fact that the pillars may contain some valuable ore which cannot be recovered. Yet, an increase in the ore extraction causes rapid deterioration of the opening boundary and a mounting cost of roof support, making the mining economically unfeasible. This situation has been substantially improved by the recent invention of the time-controlled multiple room mining method. Even with this method, outside rooms of the multiple room entry are expected to fail and, therefore, cannot be utilized as a safe mine opening without costly roof support work.

In non-mining excavation of large underground openings in incompetent ground formations, extensive anchor bolting is used for stabilizing the boundary of the opening. Effectiveness of this anchor bolting diminishes with weakness of the ground media in relation to the magnitude of the existing earth pressure. Therefore, formation of a stable opening in weak underground formations requires a large amount of work to reinforce the opening boundary.

SUMMARY OF THE PRESENT INVENTION

The present invention generally comprises a method of underground excavation which eliminates, prior to excavation, the concentration of stresses around an underground opening which might cause the opening to fail. This is accomplished by cutting one or more slots outwardly into the subsurface material ahead of the advancing excavation in any desired direction. If the slots are placed in the roof strata of the prospective room, the lateral stress in the strata will be reduced. Vertical stress in the same strata may be intensified by such slot cutting, but this will disappear as the room is finally excavated. As a result, the strata are freed from boundary deformation during the excavation while the stress envelope about the opening is caused to expand, as the tangential stresses must lie beyond the furthest extent of the slots.

The expanded stress envelope will stress relieve the ground surrounding the opening which is to be made or enlarged. The size and shape of the expanded stress envelope can be controlled by the placement, length, and number of slots employed. The stress relieved ground may be utilized as lining material for the opening by solidifying the ground with cement grouting or limited anchor bolting. The amount of anchor bolting required here is extremely limited as it is intended to restrain materials in the boundary which are subject only to direct gravity force of the magnitude of 1 to 10 psi. This gravity force is insignificant compared to commonly encountered earth pressure of 500 ~ 5000 psi which the conventional anchor bolting is intended to counteract. Therefore, the present invention practically eliminates costly requirements of boundary support and, at the same time, increases safety of the opening.

THE DRAWING

FIG. 1 is a vertical cross-sectional view of an excavated room employing a vertical roof slot.

FIG. 2 is a vertical cross-sectional view of an excavated room employing vertical roof and floor slots.

FIG. 3 is a side cross-sectional view of a device for cutting slots in advance of an excavation.

DESCRIPTION OF THE PREFERRED EMBODIMENT

Figure 4:
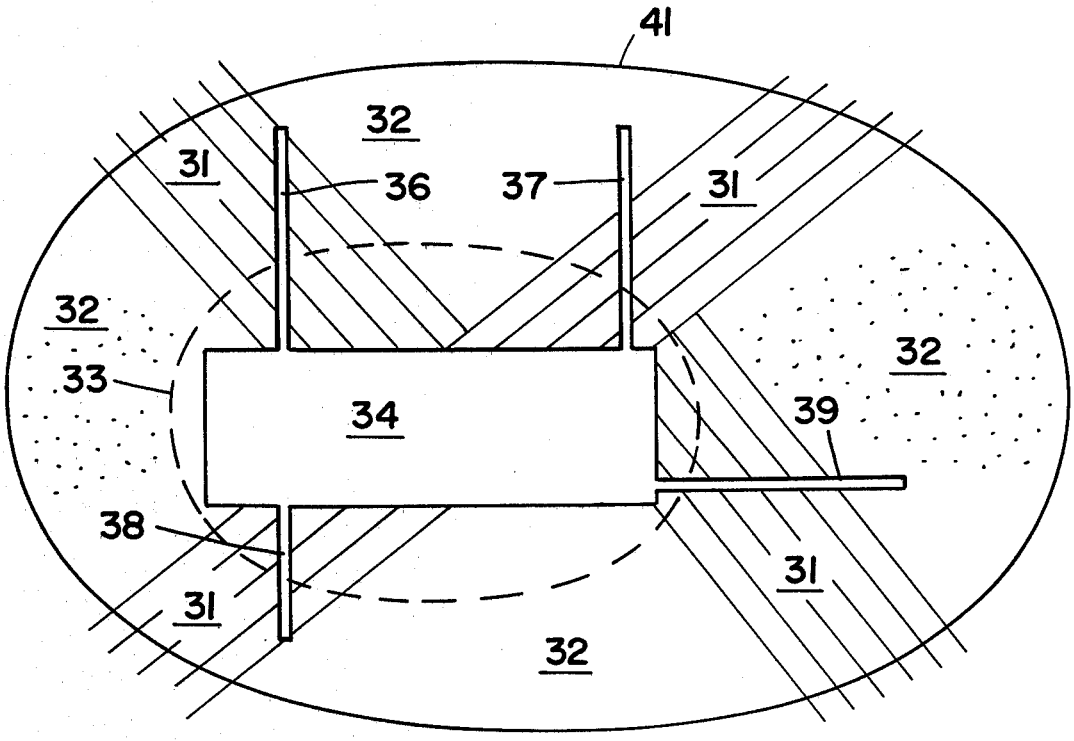
FIG. 4 is a vertical cross-sectional view of an excavated room in mixed strata employing multiple slots for stress relief.

A thorough discussion of the distribution and significance of stresses surrounding an underground opening may be found in U.S. Pat. No. 3,673,807, issued to Shosei Serata on July 4, 1972. Suffice it to say that an envelope of stresses closely surrounds any opening in the ground, and that these stresses, and in particular the tangential stresses, act to destroy the surrounding strata and cause the opening to fail. Wherever the earth pressure greatly exceeds strengths of the ground media, the degree of the destruction of the boundary ground is proportional to the amount that earth pressure exceeds the strength of the media. The present invention is directed toward expanding the stress envelope and preventing the failure of the opening with reliance on little or no mechanical support.

With reference to FIG. 1, a room or tunnel 11 excavated underground is usually surrounded by a stress envelope 12 in close proximity thereto, and these stresses are particularly destructive to the overlying strata 13. According to the present invention a circular stress envelope 10 is formed around the advanced slot 16 with the diameter of the circle determined by the length of the slot. The tangential stress in the immediate roof strata 13 is alleviated inside the circular stress envelope 10 prior to the excavation. The vertical stress in the strata may be increased along the circular envelope but this will also be alleviated as the room excavation proceeds. This alleviation of the stress in the strata permits the preservation of the natural adhesion existing within the strata which is otherwise destroyed through the process of the excavation. In addition, the present invention naturally expands the stress envelope from 12 to 14 as the final stress envelope after the excavation must lie beyond the furthest extent of the slot 16. The entire volume 17 extending between the roof 18 and the stress envelope 14 is, therefore, stress relieved and stabilized. The strata with the preserved self-cohesion in the stress-relieved ground 17 may be relied upon in many instances to maintain the integrity of the excavated room without roof support. In a case where the strata do not have a sufficient amount of natural cohesion for self-support against the gravity force of 1 ~ 10 psi, a very limited amount of cement grouting or roof bolting would suffice to maintain the strata in position. This limited artificial support is not expected to counteract the earth pressure which ranges from 100 to 5000 psi, depending upon depth and local tectonic stress intensity. The slot 16 may be effectively utilized for either cement grouting or roof bolting.

As shown in FIGS. 2 and 3, a room 19 may be excavated by first cutting a slot 21 through the strata above the roof and below the floor of the intended room. The slot through the floor strata causes the stress envelope to expand away from the floor, thereby removing the stress which often causes the floor strata to buckle. As shown in FIG. 3, the slot may be cut by a continuous mining machine 22 on which an undercutter 23 is especially mounted for vertical slot cutting. As the undercutter is swung in a vertical arc to the lower position 24, the slot 21 is formed. The face 27 of the room 19 may then be extended into the ground 26 which has been stress relieved by the slot.

Depicted in FIG. 4 is a mixed geological condition in which zones of weak strata 31 are intermixed with zones of stronger strata 32. In such a situation the stress envelope 33 surrounding a mine excavation 34 would cause the weak strata to crumble and the mine to fail. However, by cutting advanced slots 36 and 37 through the weak strata overlying the roof, the weak strata will be stress relieved and will not fail. Grouting and anchor bolting may be utilized effectively to augment the natural cohesion of the weak strata. In a similar manner slot 38 may be cut into the underlying weak strata to prevent buckling of the floor, and slot 39 cut into the adjacent weak strata to protect the wall from collapse.

Thus it may be appreciated that slots may be cut prior to excavation in any desired direction, with the general provision that the slots extend orthogonally to the initially expected stress envelope around the prospective excavation. In FIG. 4, the slots 36–39 expand the stress envelope to that shown at 41, a safe distance all around the opening. Here again, the slots may be cut by the machine shown in FIG. 3.

Figure 5:
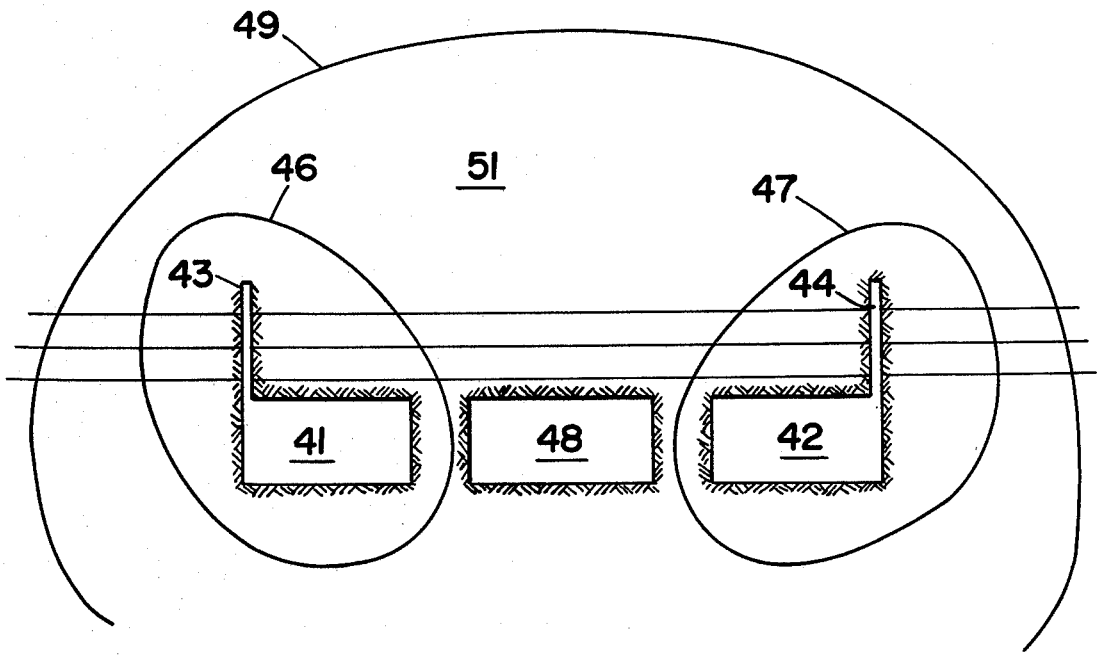
FIG. 5 is a vertical cross-sectional view of a multiple room entry mining system in which the outside rooms are protected by vertical roof slots.

The advanced slot cutting method of the present invention may also be employed advantageously in conjunction with the Method of Controlling Long Term Safety of Underground Entry System by Regulating Formation of Stress Envelopes, disclosed in U.S. Pat. No. 3,673,807, cited previously. With reference to FIG. 5, a pair of relief openings 41 and 42 are excavated in parallel, spaced relationship with slots 43 and 44, respectively, preceding the excavations. In this manner primary stress envelopes 46 and 47 are formed about the openings.

In the prior patented method, the stress relief about the excavations was provided by allowing the openings to deform excessively or to fail, the collapsed ground relieving and expanding the primary stress envelopes. In the present method the slots achieve the same end without relying on the destructive failure process. Thus the stress relief provided by the advance slot cutting permits the relief openings to remain intact.

A protected room 48 is then excavated in the ground medial to the relief openings. The combined stress envelope 49 surrounding these three excavations is sufficiently large in volume 51, and is spaced far enough from the room 48, to provide failure protection to all of the rooms without internal supports. In this improvement of the prior method the relief openings are now protected in a manner which permits safe use of all the openings. Application of this method to mining would greatly increase both safety and economy without any significant increase in expended labor or energy.

Figure 6:
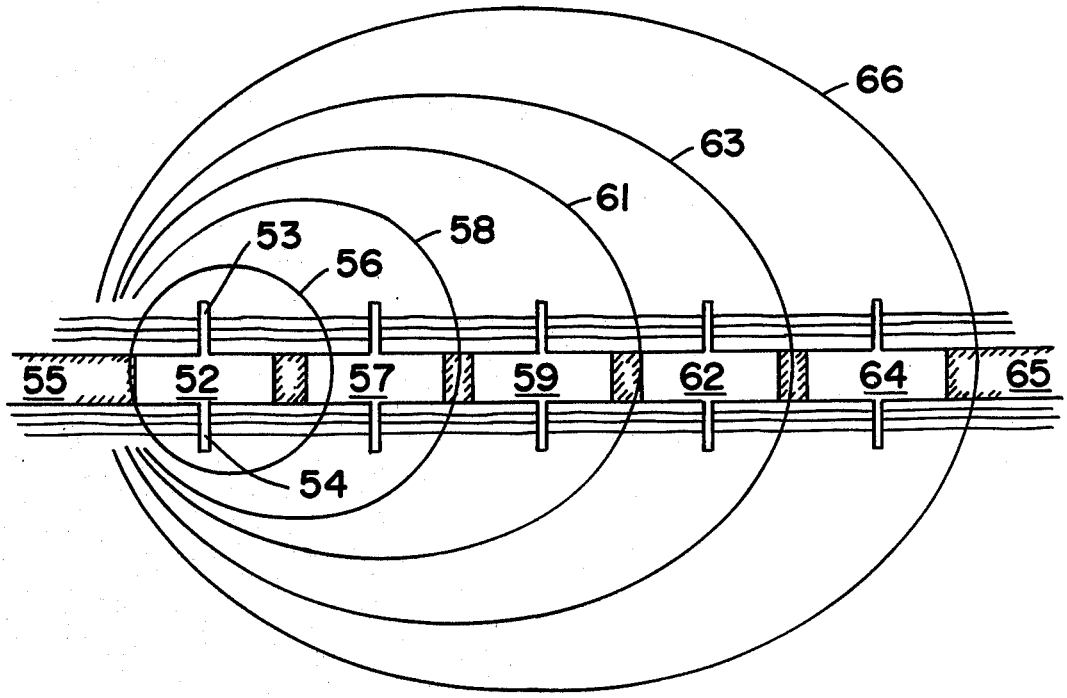
FIG. 6 is a vertical cross-sectional view of a high extraction mining system in which closely aligned parallel rooms are protected by advance slot cutting.

This method may also be employed to protect a series of sequentially excavated rooms or openings. As shown in FIG. 6, an initial room 52 may be excavated next to an abutment pillar 55 by first cutting stress relief slots 53 and 54. The room 52 may extend longitudinally quite a distance, with a stress envelope 56 protecting the room. A second room 57 may then be excavated, also using the slot cutting method to extend the stress envelope 58 to encompass both of the rooms. In this manner rooms 59, 62, and 64 are also excavated, the stress envelope expanding to 61, 63, and 66, respectively. It should be noted that at any point in the successive excavation of rooms according to this method, the current major stress envelope 66 passes through the ground 65 in which the next room is to be excavated. The practical limit to this method of excavation is the mounting intensity of stress in ground 65 which makes excavation of the new room difficult after completing 5 ~ 10 openings in adjacent relationship.

Figure 7:
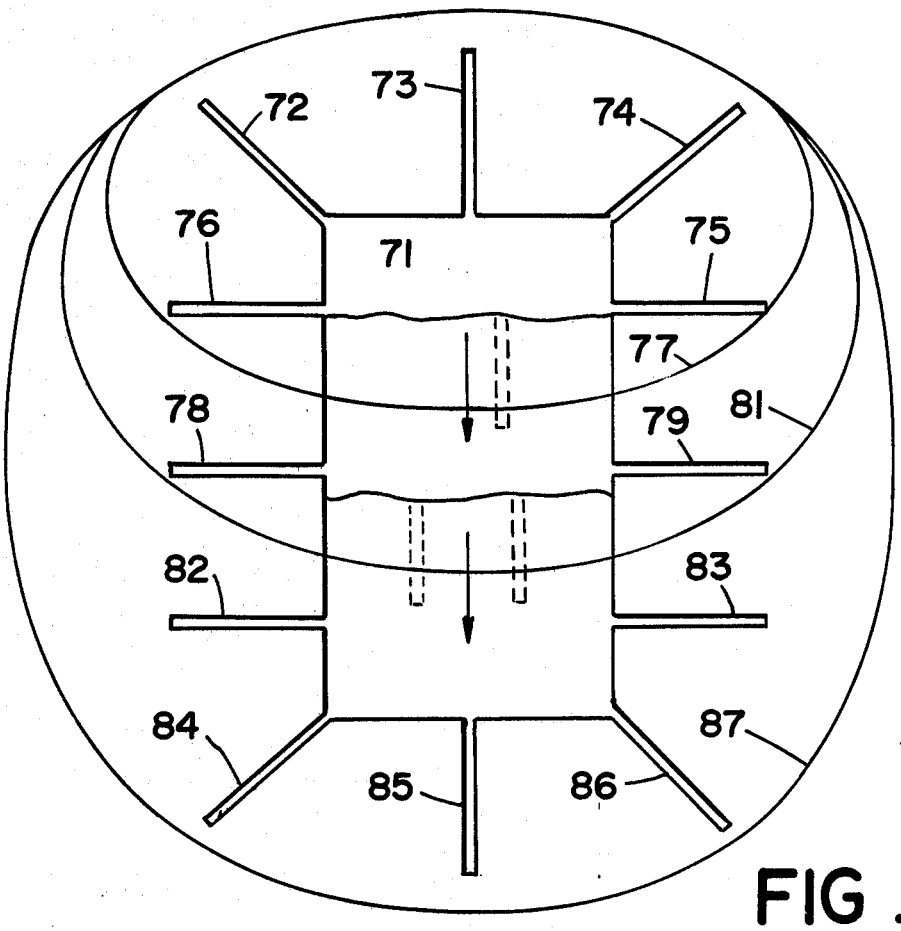
FIG. 7 is a vertical cross-sectional view of the excavation of a large underground area in unstable ground by means of advance slot cutting.

As shown in FIG. 7, a large underground excavation may be formed in unstable ground by means of the present invention. The initial opening 71 is stress relieved by slots 72–76, which cause the initial stress envelope 77 to be spaced sufficiently from the opening to prevent failure of the excavation. As the excavation proceeds downwardly, slots 78 and 79 are cut as soon as it is feasible to form the stress envelope 81. To protect further excavation, slots 82 and 83 are cut, and slots 84–86 are cut radially outwardly to form the final stress envelope 87 to protect the finished room. Intermediate slots, shown in broken line, may also be cut into the ground to be excavated to relieve, temporarily, the tangential stress in the underlying strata.

Thus it may be appreciated that the slot cutting method of the present invention will provide the necessary stress relief in many different situations to permit underground excavations to be made with increased safety and with little or no mechanical support. The extraction ratio may be increased with no increase in energy or labor, and the slots may be placed as required according to stress measurements made in situ in the excavation.

The present invention may be applied most effectively to improve the conventional method of total extraction mining of sedimentary ore deposits, such as coal, trona, and potash. The conventional total extraction method is commonly termed long-wall and short-wall mining. The extraction method today requires a massive mechanical roof support system called hydraulic checks operated mainly by hydraulic power. The present invention is able to eliminate the need for the support system. This results in a substantial saving of time, energy and labor as the requirements for use of this support system are substantial initial investment in the machinery, well trained technicians for operation of the machines, high maintenance cost, limited mobility of the machines in changing mining area, and allowance for total operational shut down due to small malfunction within the support system.

Figure 8:
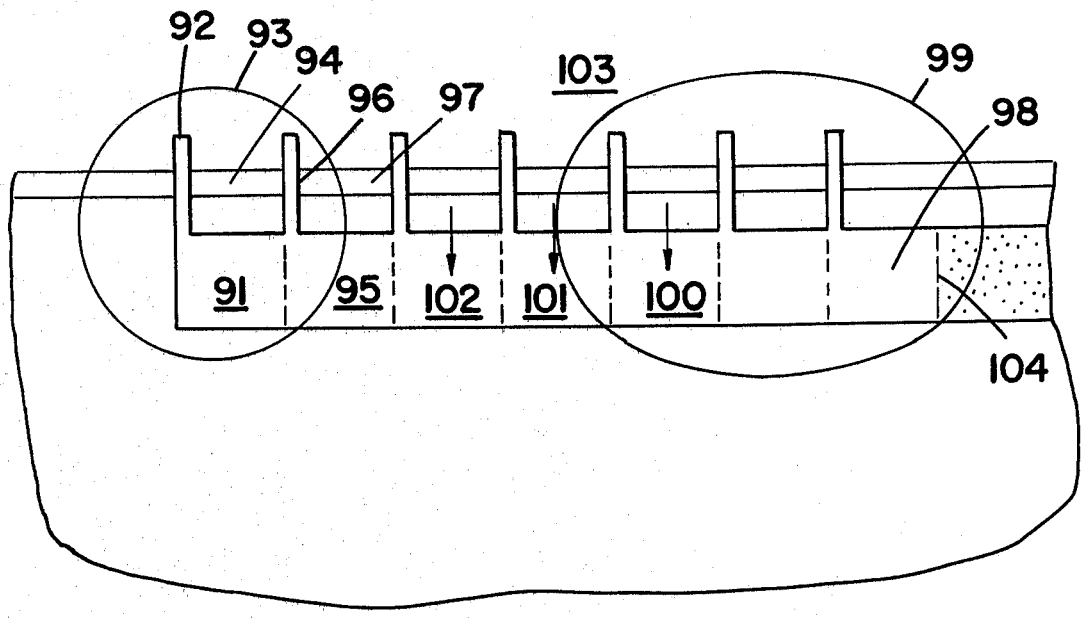
FIG. 8 is a vertical cross-sectional view of a longwall mining excavation in which the front room at the mining face is protected by the advanced slot cut vertically into the roof.

The scheme of an application of the present invention to the total extraction mining method is illustrated in FIG. 8. The mining is initiated by excavating an initiating room 91 for a long distance with an advanced slot cutting 92. The slot forms a stress envelope 93 after the mining of the room. The weak strata 94 are made stable during the excavation of the first room by a unique combination of three controlled factors, namely preserved cohesive strength of the strata, cantilever support of the strata and stress relief of the strata under the extended stress envelope.

A second room 95 would be cut by repeating the same procedure as the first. The advanced slot 96 of the second room protects the strata 97 above the working room 95, but allows the roof of the previous room to fail freely if the cohesive strength is not sufficient for self-sustenance. In this method of mining, the front mining room 98 is sufficiently protected by the latest stress envelope 99 which is formed with the support provided by the natural breakdown of the mined out ground including the rooms 100, 101, and 102, and the overburden 103. This latest protective stress envelope will advance according to the advance of the mining face 104. The amount of protection provided at the mining face is regulated by adjusting the height of the advanced slot and width of the face excavation in relation to the self-cohesion of the roof strata. The greater the slot height and narrower the room width, the greater the roof safety factor.

With this regulation, the present invention would replace the mechanical roof support system of check machines in most sedimentary ore mining. In an extreme case in which an artificial roof support is desired, a relatively simple temporary roof support would suffice. The magnitude of such support in time, material and labor would be less than one-tenth to one-hundredth of what is now required for the conventional method.

I claim:

1. A method for excavating a longitudinally extending underground opening, comprising the steps of initiating said underground opening at an excavation face, cutting at least one longitudinally extending slot through said excavation fact to interrupt and relieve the lateral shear stresses in the boundary formation around said excavation face, and thereafter excavating said face and continuing to cut said longitudinally extending slot ahead of said excavation face and wherein said longitudinally extending slot is cut generally orthogonally to the strata through which the excavation is proceeding to form a stress envelope beyond the distal extent of said at least one slot.

2. The method of claim 1 further including the step of grouting and anchor bolting through said slot into said stress-relieved strata to bond said strata together as a lining of said opening.

3. The method of claim 1, wherein said longitudinally extending slot is cut in the overlying strata and the underlying strata as well as ahead of the advancing excavation.

4. In a method of controlling long term safety of underground entry system by regulating formation of stress envelopes, the improvement comprising cutting at least one advanced slot through the boundary of the opening to be excavated for the primary relief openings to stress relieve and preserve natural cohesiveness of said ground, excavating a pair of primary relief openings through said stress-relieved ground to establish a pair of primary stress envelopes about each primary relief opening, and excavating a protected room between said primary relief openings to combine said primary stress envelopes into a secondary stress envelope spaced about the entire opening system.

5. In a method of controlling safety of total extraction mining by using a long or short wall mining method, the improvement comprising cutting at least one vertical advanced slot through the roof strata of a long wall mining room at the opposite side of the room from the mining face to protect the immediate roof strata above the mining room, simultaneously allowing previously mined out rooms to fail, the failed ground to provide a foundation to form a relatively small protective stress envelope which advances with the advancement of the mining face, providing required roof protection at the mining face by selecting the height of said roof slot and width of said mining room, to permit the total extraction of long wall mining system without the use of a massive mechanical roof supporting system.

* * * * *